US009517467B1

(12) United States Patent
Carrano et al.

(10) Patent No.: US 9,517,467 B1
(45) Date of Patent: Dec. 13, 2016

(54) POINT-OF-CARE DIAGNOSTIC CARTRIDGE

(71) Applicant: Paratus Diagnostics, LLC, Austin, TX (US)

(72) Inventors: John Carrano, Austin, TX (US); Roland Schneider, Austin, TX (US); John Jacob Carrano, Austin, TX (US)

(73) Assignee: Paratus Diagnostics, LLC, Austin, TX (US)

( * ) Notice: Subject to any disclaimer, the term of this patent is extended or adjusted under 35 U.S.C. 154(b) by 0 days.

(21) Appl. No.: 14/963,003

(22) Filed: Dec. 8, 2015

(51) Int. Cl.
*B01L 3/02* (2006.01)
*B01L 3/00* (2006.01)

(52) U.S. Cl.
CPC ..... *B01L 3/523* (2013.01); *B01L 3/502* (2013.01); *B01L 2200/16* (2013.01); *B01L 2400/0403* (2013.01)

(58) Field of Classification Search
CPC ..... B01L 3/523; B01L 3/502; B01L 3/565; B01L 3/50273
USPC ..... 422/522
See application file for complete search history.

(56) References Cited

U.S. PATENT DOCUMENTS

2002/0094583 A1* 7/2002 Seher ..... B01L 3/50273 436/180
2004/0151624 A1* 8/2004 Erdman, Jr. ..... G01N 31/22 422/417
2011/0147244 A1* 6/2011 Chan ..... G01N 33/48778 206/305
2012/0003124 A1* 1/2012 Davis ..... G01N 21/79 422/68.1
2012/0168305 A1* 7/2012 Hunter ..... B01L 3/502715 204/400
2013/0109082 A1* 5/2013 Quinn ..... B01L 3/502 435/287.2
2013/0142708 A1* 6/2013 Battrell ..... B01L 3/502776 422/430
2015/0050719 A1* 2/2015 Bammesberger ..... B01L 3/0268 435/286.5
2015/0300957 A1* 10/2015 Salsman ..... B01L 3/502 422/413

* cited by examiner

*Primary Examiner* — Jill Warden
*Assistant Examiner* — Brittany Fisher
(74) *Attorney, Agent, or Firm* — McGuireWoods LLP

(57) ABSTRACT

A specimen delivery cartridge is disclosed that includes a first housing portion, a second housing portion, a fluid dispenser, and a plunger. The plunger includes a plunger body having a first side and a second side. The second side faces away from the first side. The plunger further includes at least one post extending from the first side of the plunger body. The second side of the plunger body includes at least one actuator that is sized and configured to apply a compressive force onto the fluid dispenser when the plunger is depressed, and the plunger is thereby operable to actuate the fluid dispenser. When actuated, the fluid dispenser releases a reagent to a test specimen to facilitate testing for a target pathogen.

18 Claims, 9 Drawing Sheets

POINT-OF-CARE DIAGNOSTIC CARTRIDGE

TECHNICAL FIELD

The present disclosure relates generally to the field of medical diagnostics and more particularly to in vitro medical diagnostic devices including point-of-care in vitro medical diagnostic devices.

BACKGROUND OF THE INVENTION

There is a recognized and compelling need for the rapid and accurate diagnosis of common infectious diseases in an out-patient setting. This need results from a rapidly emerging trend toward what is sometimes referred to as "patient centric care" in which convenience—along with better health outcomes and low-cost—becomes a key market driver.

The field of in vitro diagnostics is well established, with many manufacturers and a wide spectrum of products and technologies. The testing for infectious pathogens in human patient specimens is largely confined to centralized laboratory testing in Clinical Laboratory Improvement Amendment (CLIA) rated medium-complexity or high-complexity facilities. Commonplace techniques used in such laboratories include traditional culturing of specimens, immunological assaying using Enzyme-Linked Immunosuppressant Assay (ELISA), nucleic acid testing (such as polymerase chain reaction, PCR), and other methods.

SUMMARY

In accordance with an illustrative embodiment, a specimen delivery cartridge includes a first housing portion, a second housing portion, a fluid dispenser, and a plunger. The plunger includes a plunger body having a first side and a second side. The second side faces away from the first side. The plunger further includes at least one post extending from the first side of the plunger body. The second side of the plunger body includes at least one actuator that is sized and configured to apply a compressive force onto the fluid dispenser when the plunger is depressed, and the plunger is thereby operable to actuate the fluid dispenser.

In accordance with another illustrative embodiment, a method of dispersing a reagent to a testing substrate includes closing a first housing portion of a specimen delivery cartridge toward a second housing portion of the specimen delivery cartridge. The specimen delivery cartridge further includes a plunger having a post and an actuator, and a fluid dispenser aligned with and proximate to a fluid conduit of the specimen delivery cartridge. The fluid dispenser includes a fluid. The aforementioned step of closing the first housing portion relative to the second housing portion comprises includes delivering a compressive force to depress the post, urging the actuator of the plunger to compress the fluid dispenser, and collapsing the fluid dispenser to urge fluid from the fluid dispenser to the fluid conduit.

In accordance with another illustrative embodiment, a specimen testing system includes a mating adaptor having at least one post actuator extending from a base of a receiving area of the mating adaptor. The system further includes a specimen delivery cartridge having at least one actuation port that is sized and configured to receive the at least one post actuator when the specimen delivery cartridge is inserted into the receiving area. Each actuation port provides access to a fluid dispenser, and the fluid dispenser is operable to release a metered amount of fluid into the specimen delivery cartridge upon being depressed by the post actuator.

Other features and advantages of the present invention will be apparent from the accompanying drawings and from the detailed description that follows below.

DETAILED DESCRIPTION

Figure 1:
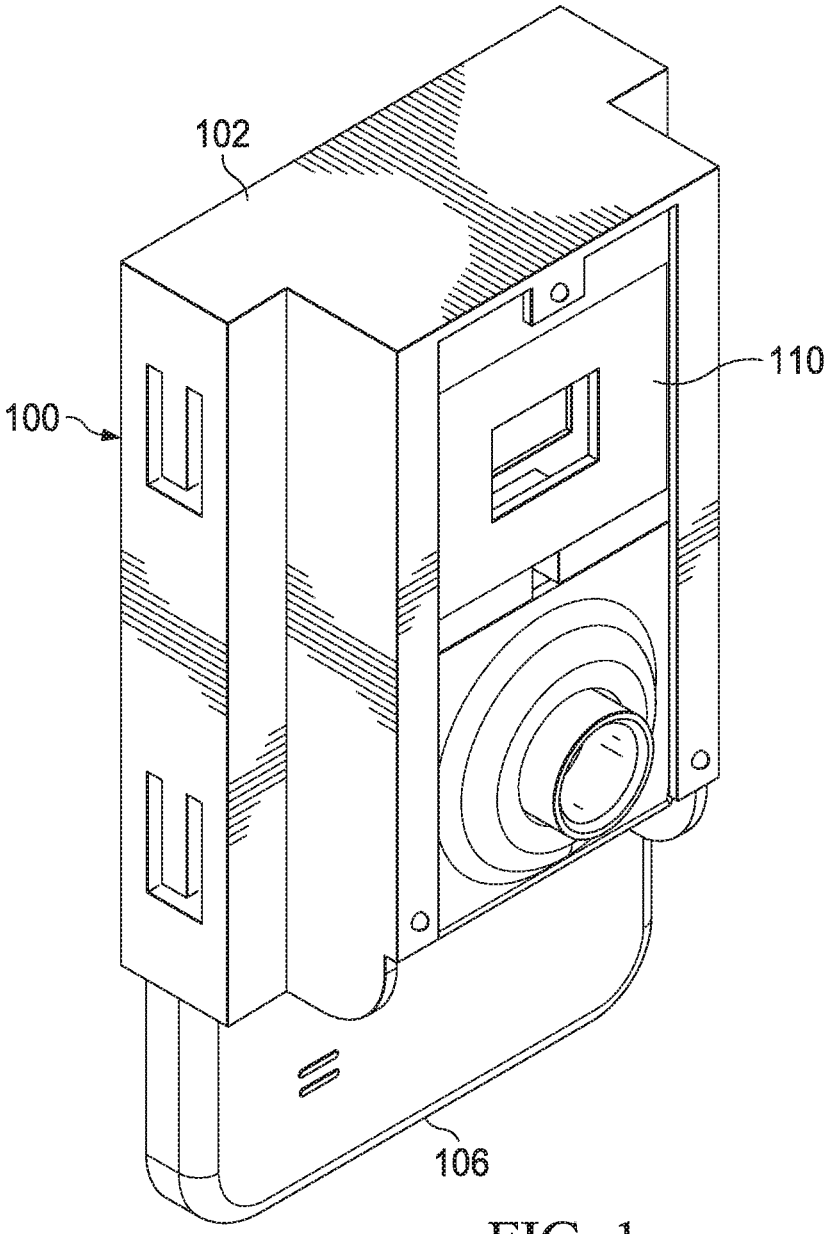
FIG. 1 is a perspective view of a specimen delivery cartridge and computing device coupled to a mating adaptor.

The conventional model for infectious disease diagnosis relies heavily on centralized laboratory testing (e.g. culture), which can often take two to four days to provide a reliable result. Applicant performed time-and-motion studies of medical practice and patient flow in the current model of infectious disease diagnosis and compared it to the new model relying on the devices described in this disclosure. A consequence of the conventional model is that patients are not necessarily properly diagnosed on their first visit; nor are they given the correct drug prescription. This results in money wasted on either incorrect or unnecessary prescriptions, inconvenience to patients owing to repeat visits, and even the potential for otherwise treatable illnesses to progress to more serious conditions requiring expensive hospital stays. In addition, it is noted that the over-prescription of antibiotics is not only a cost burden to the healthcare system, but perhaps more importantly may contribute to the increasing frequency of antibiotic resistant strains in the community, which is a national health concern.

There are some rapid diagnostic tests (RDTs) on the market today that are suitable for use in an out-patient setting. These RDTs, however, are simple "rule-in/rule-out" tests which do not necessarily inform clinical decision-making. Furthermore, many of these RDT's suffer from poor sensitivity and specificity, making the validity and clinical utility of their results dubious at best.

In diagnosing a patient, it is common for a physician to ask is whether an illness is the consequence of a bacterial or a viral pathogen. The present disclosure relates to a system that is able to provide that answer during the patient visit and with gold-standard accuracy. In this way, the correct diagnosis is obtained, and the best treatment option prescribed.

In point-of-care diagnostics for infectious disease, a premium is placed on the ability to achieve low-complexity and low-cost while substantially improving health outcomes. Further, to leverage the ubiquity of smartphones and other computing devices in common use globally, a mating adaptor may allow for the use of a computing device, such as a smart phone, in connection with a mating adaptor and specimen delivery cartridge, to carry out a test for one or more pathogens. The mating adaptor accommodates the form factor and interfaces of popular computing devices (e.g., smart phones) by providing for a variety of interfaces. Each interface may equate to a customized adaptor that is designed to mate with a particular computing device. However, the adaptor interfaces to the cartridge will generally be identical; meaning that the cartridge will fit to any of a variety of a range of adaptors that accommodate a corresponding range of smart phones or other computing devices.

The specimen delivery cartridge may be considered to be similar in some respects to the cartridge or "specimen delivery apparatus" described in earlier-filed patent application Ser. No. 13/918,877 entitled "Specimen Delivery Apparatus" submitted by applicant, which is hereby incorporated by reference.

Referring now to FIG. 1, in an illustrative embodiment, a mating adaptor 102 is sized and configured to receive and pair a computing device 106 and a specimen delivery cartridge 110. The mating adaptor 102 has a first receiving area that is sized and configured to receive the computing device 106, which may be, for example, a popular smart phone. The mating adaptor 102 also has a second receiving area that is sized and configured to receive the specimen delivery cartridge 110. The aforementioned pairing results in one or more of a physical coupling, optical coupling, thermal coupling, communicative coupling, or electrical coupling between the computing device 106 and the specimen delivery cartridge 110.

A representative specimen delivery cartridge 200 is described in more detail below with regard to FIGS. 2-8. Owing to the enormous amount of research and development funds invested in the development of computing devices, certain capabilities exist with such devices that are relevant to biological detection and clinical diagnostics. However, one capability that an off-the-shelf smartphone lacks is the ability to directly manipulate fluids within its existing form factor, or to accept bodily fluid specimens directly for analysis. The specimen delivery cartridge 200 may be regarded as a consumable cartridge which resolves the problems associated with acquiring a wide variety of human, animal, agricultural, or environmental specimens and introducing those safely into a point-of-care diagnostic system for further assaying. This assaying may involve some or all of the following steps: the introduction of additional biochemical reagents; the mixing and agitation of said fluids; the heating of various but specific fluids for distinct periods of time (known commonly as incubation); the use of filters; and the use of various types of particles, some of which might be magnetic in nature.

In an embodiment, the specimen delivery cartridge 200 is a sealed device that may receive and process a fluid specimen without exposing the computing device 106 or mating adaptor 102 (described with regard to FIG. 1) to the fluid specimen. In such an embodiment, all fluids, reagents, specimens and any other liquid materials are safely contained internal to the specimen delivery cartridge 200, and there is no fluid flow between any of the three foregoing components.

The mating adaptor 102 shown is illustrative only and it is noted that different versions of mating adapter may be fabricated to accommodate different types of computing devices on the market. In an embodiment, the computing device 106 is a smart phone, and it is noted that the computing device 106 may be made in any number of dimensional configurations, each corresponding to a separately fabricated smart phone. Similarly, the mating adaptor 102 accommodates any specimen delivery cartridge 110, regardless of the type of specimen used or assay format. In this sense, the mating adapter serves as a universal link for coupling a specimen delivery cartridge to a computing device.

To link the computing device 106 to a specimen delivery cartridge, a user or operator first slides the mating adaptor 102 over the computing device 106. This is a simple action that requires no special training and is intuitively obvious from the shape of the adapter. To prompt the user to take the correct action in forming the link, a visual indicator, such as an arrow pointing in the direction the computing device 106 should be slid to engage the mating adaptor 102, is included on the surface of the mating adapter. A written instruction may also be embossed on the mating adaptor 102 to ensure complete clarity. Similar orienting features may be included on the specimen delivery cartridge 200.

Figure 2:
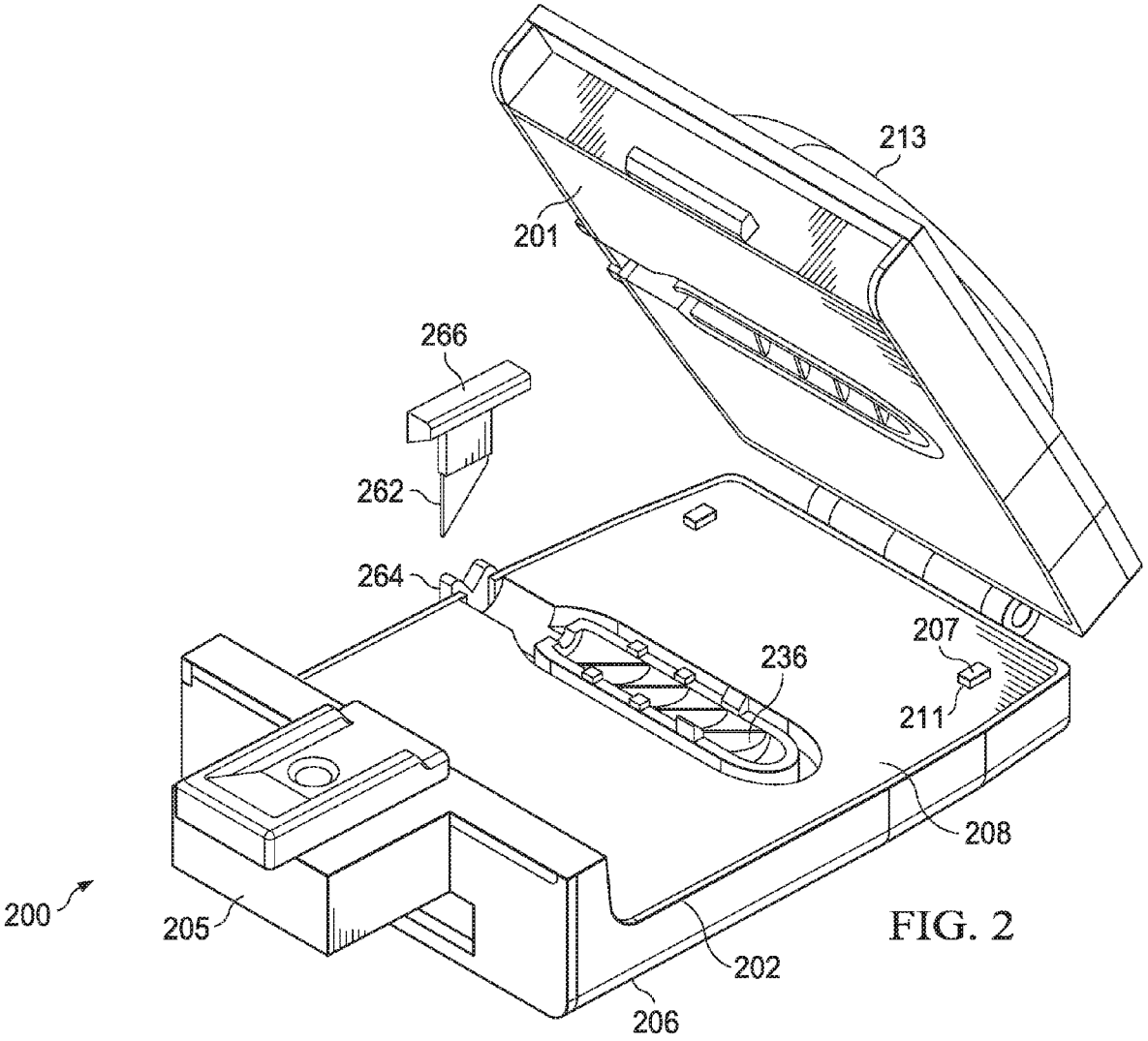
FIG. 2 is a perspective view of an embodiment of a specimen delivery cartridge in accordance with an illustrative embodiment.
Figure 3:
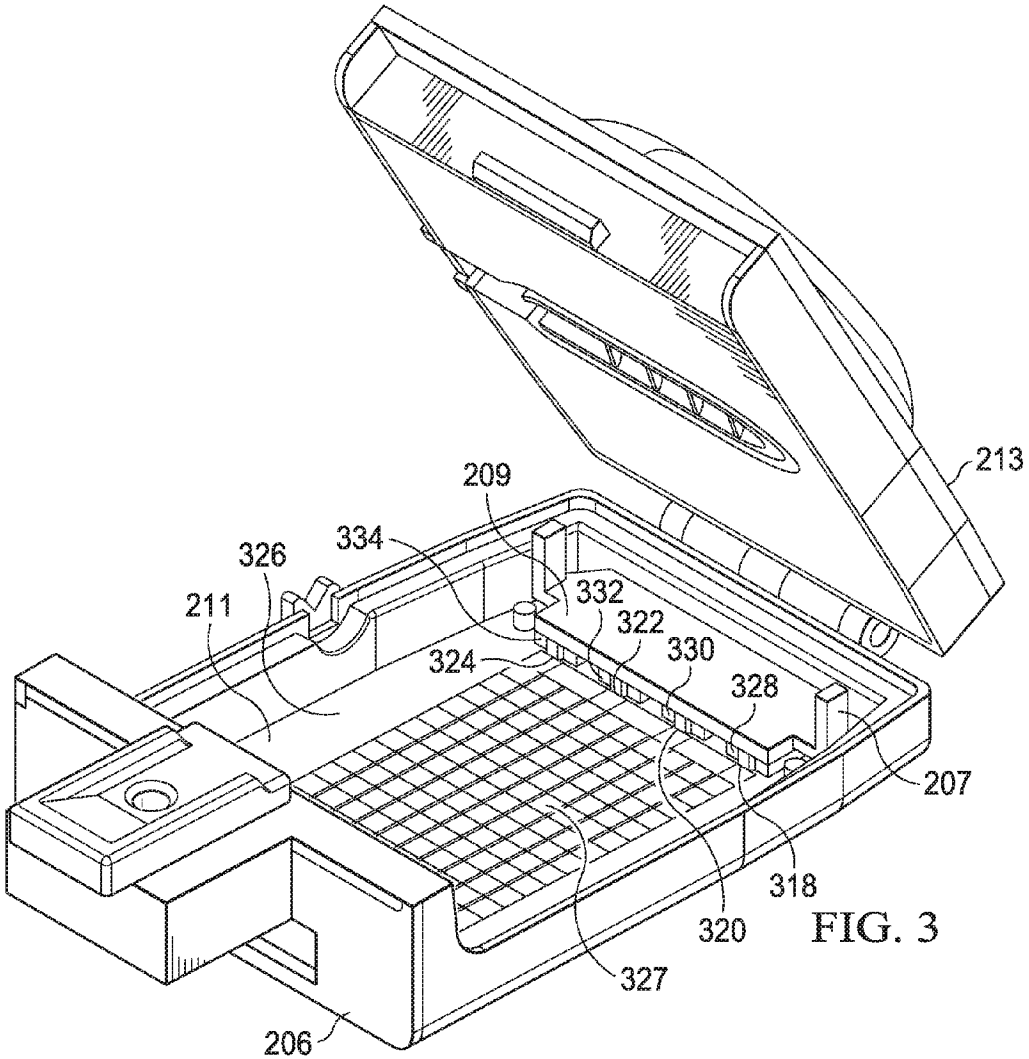
FIG. 3 is a perspective view of the specimen delivery cartridge of FIG. 2 in which the specimen delivery cartridge is in an open configuration to reveal a test substrate.

Referring now to FIGS. 2-3, an illustrative embodiment of a specimen delivery cartridge 200 is shown. The specimen delivery cartridge 200 includes actuation posts 207 that form a portion of a plunger 209 (FIG. 3). The plunger 209 is designed to cause a precise, metered delivery of previously stored reagents on to a surface for subsequent assay processing steps. The plunger 209 is positioned below a lower intermediate member 208, shown here as a generally planar member. The lower intermediate member 208 may include arcuate or otherwise nonplanar surfaces in other embodiments. In some embodiments, a lower vessel cavity of a specimen collection chamber 236 resides in the lower intermediate member 208. The posts 207 protrude from a lower housing 202 through the lower intermediate member 208 at actuator ports 211. In addition to providing access for the posts 207, actuator ports 211 may also serve to provide mechanical stability and alignment of the plunger to complimentary reagent storage packs or reservoirs below the lower intermediate member 208.

A lower housing body 206 of the specimen delivery cartridge 200 supports and may partially enclose the lower intermediate member 208. Similarly, an upper intermediate member 201, shown as a second planar component, is supported and partially enclosed by an upper housing body 213 of the specimen delivery cartridge 200. A locking mechanism 205 secures the upper housing body 213 to the complimentary lower housing body 206 of the specimen delivery cartridge 200. A swab holder 264 provides for the easy alignment of a swab that may be used to deliver a specimen into the specimen collection chamber 236 as well as to secure positioning of the swab as a result of the snapping of the swab shaft into holder 264. A built-in cutter 262 cuts the swab shaft off upon depression of the cutter button 266.

As described in more detail below, the specimen delivery cartridge may include a plunger that is operable to introduce various reagents necessary for the execution of a particular assay protocol once a swab is positioned within the specimen collection chamber 236. In such an embodiment, certain reagents may be pre-packaged as components contained in the specimen delivery system cartridge 200.

In order to maintain low-complexity operation, a user of the specimen delivery cartridge 200 may not have to be directly involved in measuring, pipetting, introducing, or using reagents separate from the cartridge to perform the assaying steps. To that end, the plunger mechanism may assist in operation of the specimen delivery cartridge 200 by automatically dispensing pre-determined and metered amounts of one or more reagents in to or on to a follow-on device, channel, or substrate.

This automatic operation may be accomplished by the closing of the upper housing body 213 toward the lower housing body 206, which causes the plunger posts 207 to be pushed down a pre-determined distance. With the lower housing body 206 removed (for illustrative purposes), as shown in FIG. 4, one can observe that the plunger 209, in some embodiments, has a one-piece construction that includes the actuation posts 207.

As shown in FIG. 3, the plunger 209 is configured to perform metered dispensing of reagents from fluid dispensers or reservoirs, shown here as four reagent storage packs 318, 320, 322, 324. The plunger 209 can be designed and fabricated to dispense from any suitable number of fluid dispensers (1, 2, 3, 4, . . . n) depending on the assay being conducted and certain limiting factors such as the overall size (volume) of the available space within the specimen delivery cartridge 200. The plunger 209 is operable to depress the reagent packs 318, 320, 322, 324 to cause the fluid dispensers to dispense reagent on to an adjacent substrate surface 326 (plastic, paper, polymer, PCB, glass, sapphire, composite, metal, or other material) or into an adjoining fluid transfer channel 327. In the illustrated embodiment, upon activation of the plunger 209, reagents from four fluid dispensers are dispensed on to specific "landing pad", shown here as metal electrodes 328, 330, 332, 334.

Figure 4:
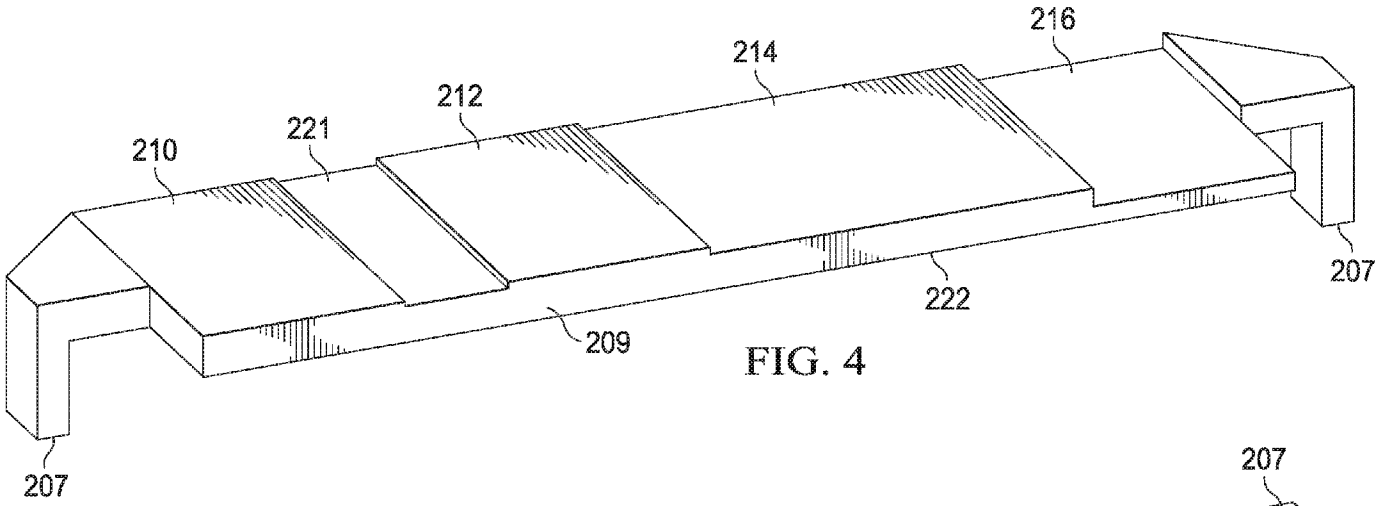
FIGS. 4 and 5 are opposing, perspective views of an actuator that may be included in the specimen delivery cartridge of FIG. 2.
Figure 5:
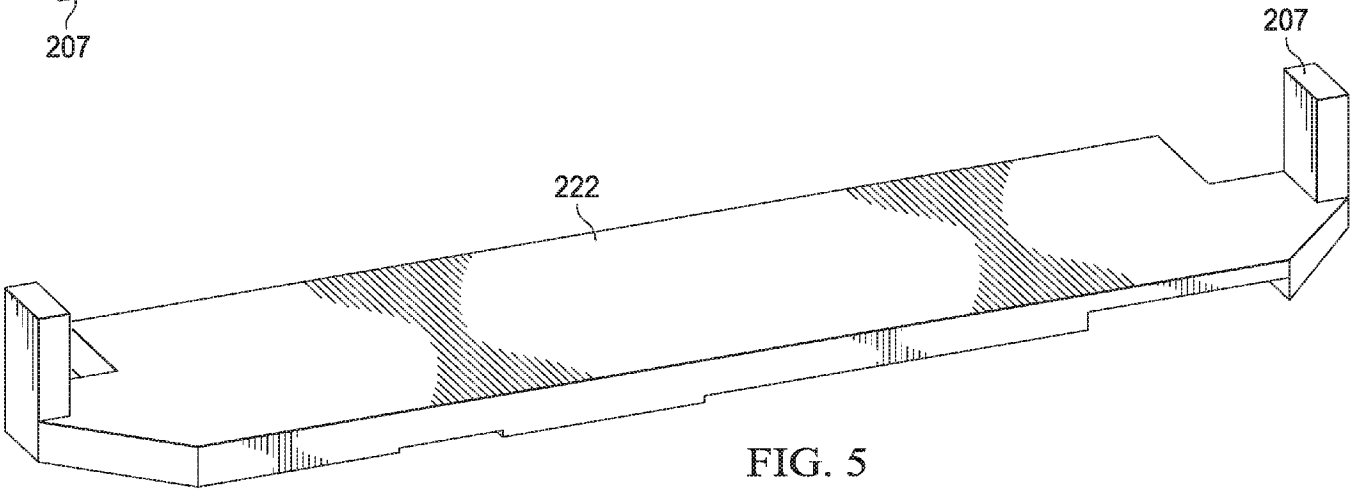

Referring now to FIGS. 4 and 5, an illustrative embodiment of the plunger 209 is shown as having a plurality of actuation surfaces 210, 212, 214, 216. The plunger 209 is sized and configured to engage a complimentary surface or surfaces of fluid dispensers (e.g., reagent packs 318, 320, 322, 324), by virtue of the offset actuation surfaces 210, 212, 214, 216. The plunger 209 has a first side 221, from which the plurality of actuation surfaces 210, 212, 214, 216 extend, and a second side 222 opposite the first side, from which posts 207 extend. In some embodiments, the actuation surfaces 210, 212, 214, 216 are planar. In other embodiments, however, the actuation surfaces 210, 212, 214, 216 may be slotted, curved, keyed, or of another suitable shape that is selected to complement and engage the shape of the fluid dispensers to be actuated by the actuation surfaces 210, 212, 214, 216. The posts 207 are arranged to be depressed upon the closing of the specimen delivery cartridge 200.

In the illustrated embodiment, each of the plurality of actuation surfaces 210, 212, 214, 216 are offset by a predetermined distance to correspond to selected order, volume, or rate of discharge (or a combination thereof) of fluid dispensers to be actuated by the actuation surfaces 210, 212, 214, 216. Here, the plunger 209 has a first actuation surface 210 of a particular thickness corresponding to the volume of reagent intended to be dispensed from the corresponding fluid dispenser. The plunger 209 may have a second actuation surface 212 of a particular thickness (the same or different thickness than actuation surface 210). In like manner, the plunger 209 may have a third actuation surface 214 of another particular thickness, and so on to an nth number of actuator surfaces of particular thicknesses.

The plunger 209 may be fabricated from a single piece of material, such as a molded plastic. In other embodiments, however, different surfaces of the plunger 209 may be fabricated from separate materials and later combined into one structure using welds, adhesives, or other joining mechanisms.

Figure 6:
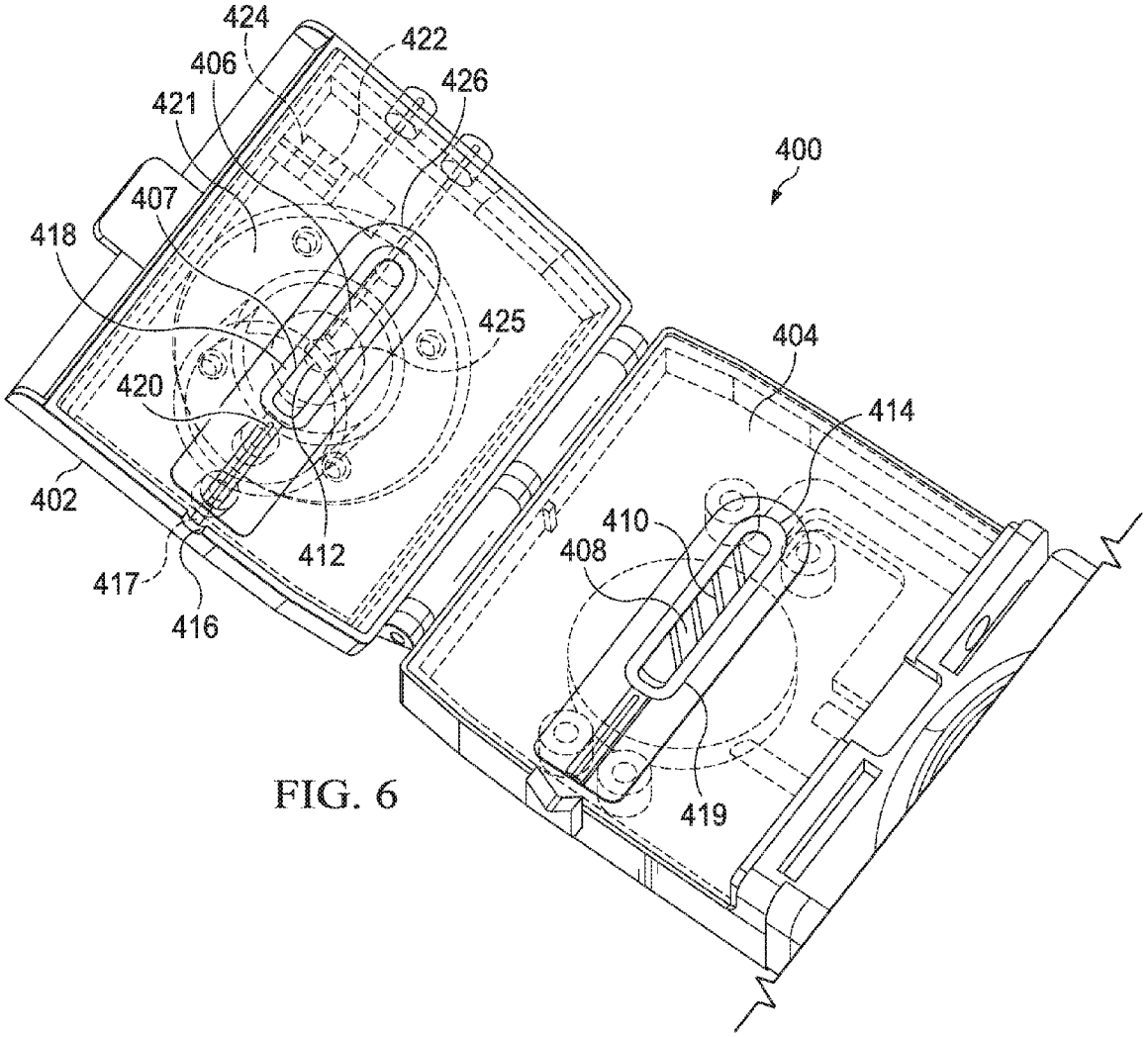
FIG. 6 is a perspective view of a portion of the specimen delivery cartridge of FIG. 2, showing components of a first housing portion of the specimen delivery device.

FIG. 6 shows an embodiment of a specimen delivery cartridge 400 that is analogous to the specimen delivery cartridge 200 described above. The specimen delivery cartridge 400 includes a first housing portion 402 and a second housing portion 404. The first housing portion 402 includes a first vessel cavity 406 and the second housing portion 404 includes a second vessel cavity 408. When the first housing portion 402 and second, opposing subassembly are closed together, the first vessel cavity 406 and second vessel cavity 408 close to form opposing halves of a specimen collection chamber 407 that accommodates a swab. The swab can be one of a plurality of sizes, shapes, and material and is used to collect a specimen (e.g., from a patient), for placement in the specimen collection chamber 407. The specimen collection chamber 407 includes a roiling mechanism 410 that is designed to mix or generate a vortexing flow of fluids (such as an elution reagent, lysis reagent, or other liquid) through the specimen collection chamber 407 to interact with particles on the swab and release such particles into the fluid for subsequent processing.

The specimen collection chamber 407 is operable to deliver fluid to a subsequent component of the specimen delivery cartridge 400 after the fluid has interacted with the specimen-containing swab. To that end, the specimen collection chamber 407 includes a fluid inlet 412, which may referred to as a fluid inlet orifice, and a fluid outlet 414, which may be referred to as a fluid outlet orifice. The fluid inlet 412 is operable to provide the fluid to the specimen collection chamber 407 and the fluid outlet 414 is operable to drain or otherwise remove the fluid from the specimen collection chamber 407. Each of the fluid inlet 412 and fluid outlet 414 may be an open flow path or may include a one way valve to restrict and direct fluid flow into and out of the specimen collection chamber 407. An elution button 421 is positioned on the backside of the first housing portion 402 and is operable to inject fluids fluid to the specimen collection chamber 407 and to induce roiling, stripping of specimen from swab, mixing, and movement of fluid from the specimen collection chamber 407. In an embodiment, the elution button 421 is an expandable and compressible diaphragm that is operable to manipulate fluid within the specimen collection chamber 407.

The specimen collection chamber 407 includes a swab entry 416 where the shaft of a swab crosses the boundary of the specimen delivery cartridge 400 and is sealed by swab gasket 418 to prevent leaking of fluids in the specimen collection chamber. In some embodiments, the swab gasket 418 has a series of ridges 420 to reduce in serial fashion the pressure drop between the inside of the specimen collection chamber 407 and that of the ambient environment surrounding the specimen delivery cartridge 400. Swab gasket 418 abuts a complimentary chamber gasket 419 that forms a complete seal of the swab inside the specimen delivery cartridge 400. In one embodiment, the swab gasket 418 and chamber gasket 419 are formed by a self-aligned molding process whereby a portion of the structure of the specimen delivery cartridge forms the mold for the gasket material (which can be rubber, synthetic polymer, or other elastomeric material). In accordance with such a process, the each of the swab gasket 418 and chamber gasket 419 may be considered to be an over-molded part. The over-molding process may be implemented using a mold cavity that is configured to receive a portion of the cartridge to which the gasket is affixed, and to use the received portion of the cartridge as a mold surface on which the applicable gasket may then be molded. This type of manufacturing process combines what would typically be an assembly step with the fabrication process of molding, and thereby allows for retention features to be built into the cartridge to better retain the gasket than if the gasket were a purely assembled part. For example, the portion of the surface of the second housing portion 404 that receives the chamber gasket 419 may be scored or etched prior to molding.

Figure 6A:
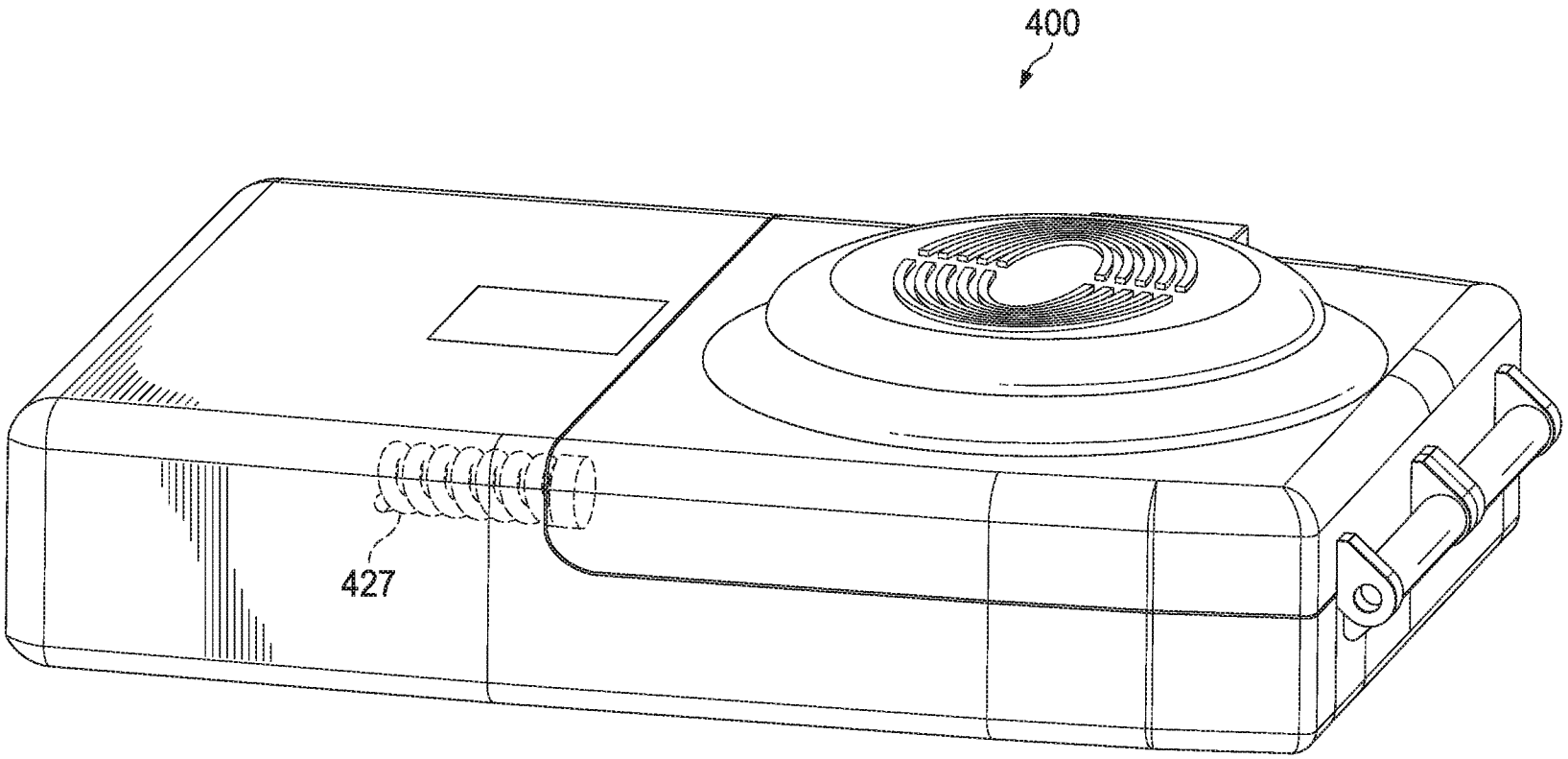
FIG. 6A is a perspective view of the specimen delivery cartridge of FIG. 2 in a closed configuration, in which a second housing portion is shown in hidden line to reveal a spring-actuated plunger mechanism.

FIG. 6 shows a leaching chamber 426 of the specimen delivery cartridge 400 that comprises a holding unit, such as leaching chamber 426 into which certain reagents and particles may be pre-loaded as part of a manufacturing step. In an embodiment, the reagents and particles may be stored within a fluid enclosed within a blister pack or other suitable container that is inserted into the leaching chamber 426. The leaching chamber 426 is operable to introduce certain reagents useful to the execution of the given assay protocols. In some embodiments, the leaching chamber 426 is actuated upon closure of the first housing portion 402 toward the second housing portion 404 such that a latch or linkage is actuated upon closure to release a spring-loaded actuator, shown as spring-loaded plunger 427 (shown in the alternative view of the specimen delivery cartridge 400 of FIG. 6A) to actuate a piston 424 that pushes a gasket 422 through the leaching chamber 426 to propel fluid stored in the leaching chamber 426 toward the specimen collection chamber 407. The gasket 422 thereby seals the leaching chamber 426 and provides a means for propelling ensconced reagents from the leaching chamber 426 into the specimen collection chamber 407. The contents of the leaching chamber 426 are delivered into the specimen collection chamber 407 through a leaching chamber reagent inlet 425. The leaching chamber 407 can hold a variety of reagent types including, but not limited to, mucolytic agents to break-up mucus specimens, lysis buffer to burst cells and release the contained genetic material, oligonucleotides, antibodies, microspheres, magnetic beads, particles, and other reagent types. In an embodiment, the actuation mechanism for propelling fluid into the specimen collection chamber 407 includes a spring-actuated piston 424 that is released upon the closing and first housing portion 402 toward the second housing portion 404. The spring-actuated piston 424 is designed to have the correct amount of energy to move the gasket 422 an appropriate distance to dispense the fluid contained in the leaching chamber 426 into the specimen collection chamber 407.

Figure 7:
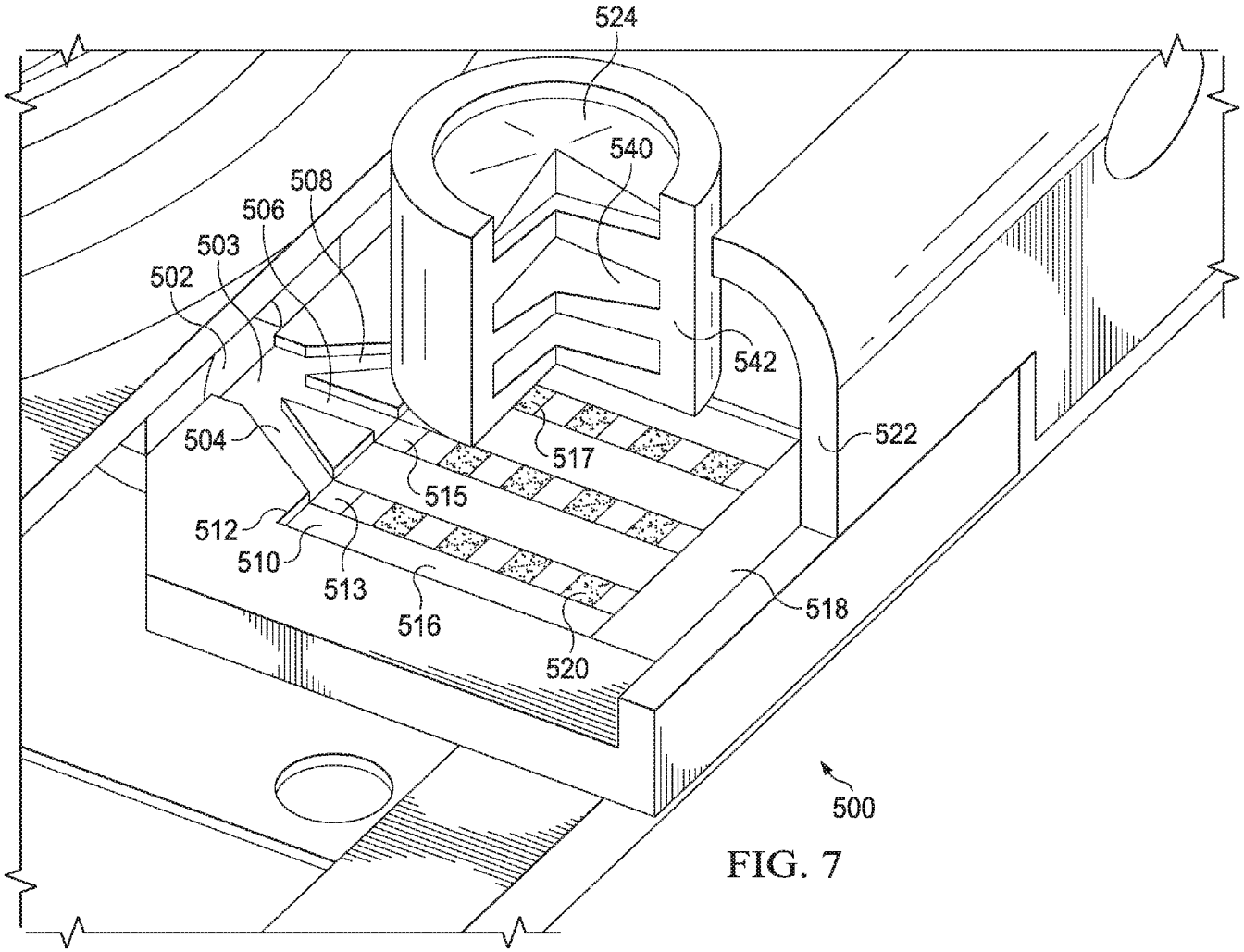
FIG. 7 is a schematic view of an assaying portion of a specimen delivery cartridge.
Figure 8:
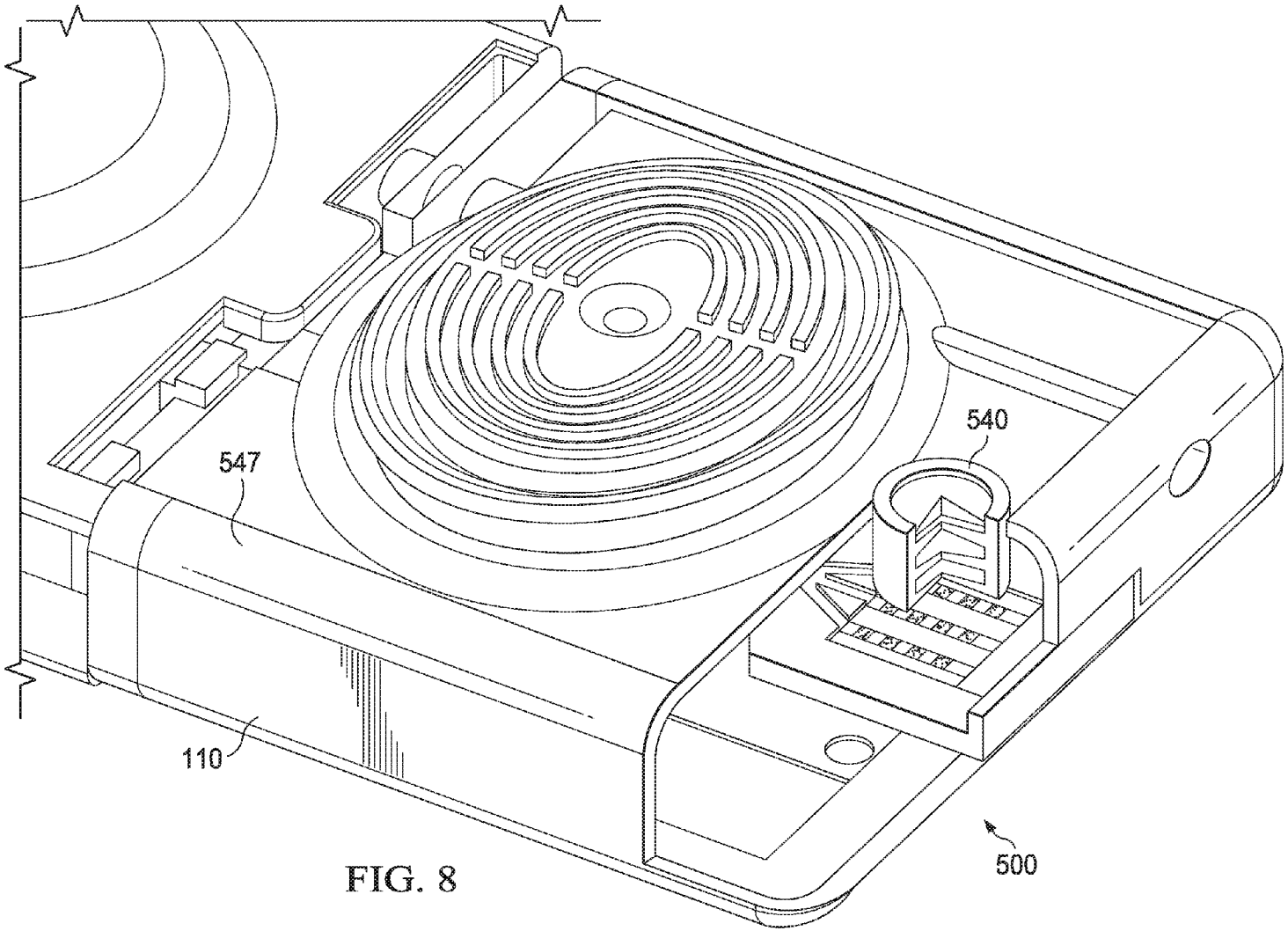
FIG. 8 is a schematic view of an assaying portion of a specimen delivery cartridge in partial cutaway.

FIGS. 7 and 8 show a detecting portion of a specimen delivery cartridge 500, which is analogous to the specimen delivery cartridge 400 and specimen delivery cartridge 200 described above. The detecting portion is enclosed by a super-structure, shown as housing 522. The super-structure may be a sub-housing or one contiguous piece of the specimen delivery cartridge body. The housing 522 may be fabricated from a plurality of materials including but not limited to plastic, polymer, composite, metal or other materials. In some embodiments, a reagent mixture consisting of the outputs from a given set of assay protocols is deliverable as a fluid from the specimen collection chamber through channel 502 to a splitter 503. The splitter 503 feeds one or more downstream channels, shown as first downstream channel 504, second downstream channel 506, third downstream channel 508 (up to an nth downstream channel). Each of the downstream channels 504, 506, 508 are coupled to and operable to deliver fluid onto a paper diagnostic 510 at interfaces 513, 515 up to the nth interface 517. The division of the original fluid path into n separate channels allows for more rapid detection owing to parallelism, and the areal efficient design of a paper diagnostic 510. The paper diagnostic 510 may be fabricated from a variety of materials including but not limited to paper, nitro-cellulose, and other materials with suitable wicking properties. The paper diagnostic 510 is supported by a holder 512. The holder 512 may be fabricated from a variety of materials including but not limited to plastic, polymer, composite, metal, glass or other suitable materials. In one embodiment, the paper diagnostic is patterned into flow channels using an appropriate hydrophobic material to confine fluid flow and prevent cross-talk between adjacent channels.

FIGS. 7 and 8 illustrate the arrayed paper diagnostic 510 and its position relative to an optical element 540. The housing of the specimen delivery cartridge has been partially cut-away to allow for viewing of the internal components. The cutaway view shows that the optical element 540 allows for high quantum efficiency collection of photons emanating from the paper diagnostic 510. The optical element may consist of some or all of a combination of lenses (e.g., lens 524 shown in FIG. 7), coatings, mirrors, diffractive elements, filters, and other optical components. The optical element is supported by the element carrier 542 which may be fabricated from a variety of materials to include but not limited to plastic, polymer, composite, metal, or other suitable material.

In some embodiments, the optical element 540 is operable to capture chemi-luminescent photon emission from the diagnostic substrate 516 such that emitted light is reimaged onto the optical sensor (CMOS/CCD/similar) of the computing device. The optical element 540 may have one or more lenses and one or more filters. In the illustrated embodiment, each colored spot puts out an emission at a colored wavelength (maybe visual spectrum or infrared). The emission is indicative of a test result or detection of a pathogen. An optical sensor, which may be included in the specimen delivery cartridge or accessed using a computing device, is operable to detect the emission to derive a test result. The configuration of the substrate 516 and characteristics of locations on the test strip 520 of the substrate 516 may be configured to detect different pathogens. In such an embodiment, the optical sensor, used in conjunction with the specimen delivery cartridge is operable to detect multiple pathogens simultaneously by detecting multiple wavelengths or multiple positions as a result of previously placed reagents on the test strip 520. The optical result may be stored and analyzed, and can be correlated to lookup table to determine pathogens present.

In another embodiment, a light pipe may be used to transmit light to or from an optical interface that is located at another position on the specimen delivery cartridge that is positioned away from the optical interface 540 but that may correspond to the position of an optical sensor included on a computing device.

Figure 9:
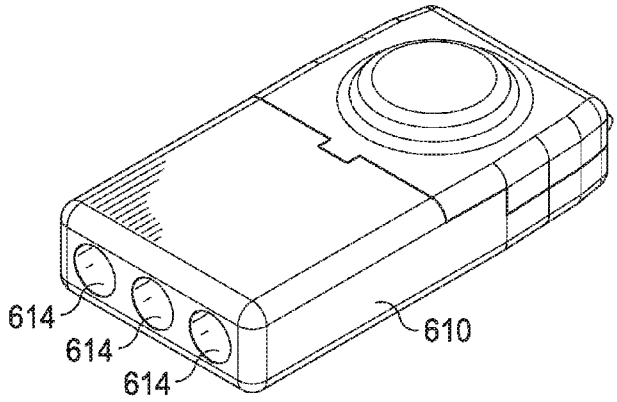
FIG. 9 is a perspective view of an embodiment of a specimen delivery cartridge.
Figure 10:
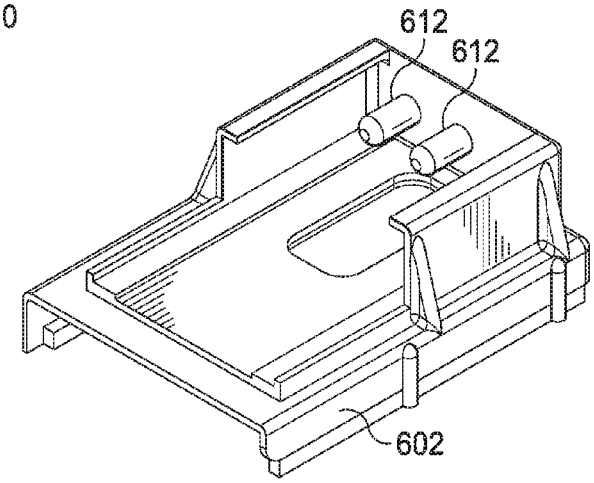
FIG. 10 is a perspective view of an embodiment of a mating adaptor, analogous to the mating adaptor of FIG. 1.
Figure 11:
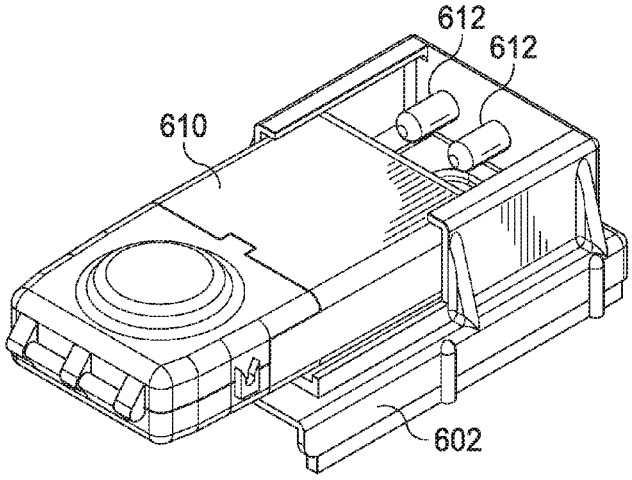
FIG. 11 is a perspective view of the specimen delivery cartridge of FIG. 9 being assembled to the mating adaptor of FIG. 10.

FIGS. 9-11 illustrate another embodiment of a specimen delivery cartridge 610 having actuation ports 614 and a mating adaptor 602 that includes post actuators 612. The post actuators 612 extend from a base surface of the mating adaptor 602 into a receiving area that is configured to receive the specimen delivery cartridge 610 to engage actuation ports 614. The actuation ports 614 may in turn comprise blister packs or other, similar fluid dispensers that release a fluid within the body of the mating adaptor 602 upon being compressed by the post actuators 612. The post actuators 612 may be included in the illustrated system of FIG. 11 in lieu of or in addition to the plunger 209 (described above with regard to, e.g., FIG. 4), and may thereby be operable to cause the release of a metered amount of fluid from one or more reagent packs or other fluid dispensers upon insertion of the specimen delivery cartridge 610 into the receiving area of the mating adaptor 602.

It is noted that unless an embodiment is expressly stated as being incompatible with other embodiments, the concepts and features described with respect to each embodiment may be applicable to and applied in connection with concepts and features described in the other embodiments without departing from the scope of this disclosure. To that end, the above-disclosed embodiments have been presented for purposes of illustration and to enable one of ordinary skill in the art to practice the disclosure, but the disclosure is not intended to be exhaustive or limited to the forms disclosed. Many insubstantial modifications and variations will be apparent to those of ordinary skill in the art without departing from the scope and spirit of the disclosure. The scope of the claims is intended to broadly cover the disclosed embodiments and any such modification.

As used herein, the singular forms "a", "an" and "the" are intended to include the plural forms as well, unless the context clearly indicates otherwise. It will be further understood that the terms "comprise" and/or "comprising," when used in this specification and/or the claims, specify the presence of stated features, steps, operations, elements, and/or components, but do not preclude the presence or addition of one or more other features, steps, operations, elements, components, and/or groups thereof. In addition, the steps and components described in the above embodiments and figures are merely illustrative and do not imply that any particular step or component is a requirement of a claimed embodiment.

The invention claimed is:

1. A specimen delivery cartridge comprising:
a first housing portion;
a second housing portion;
a fluid dispenser; and
a plunger comprising a plunger body having a first side and a second side, the second side facing away from the first side, and further comprising at least one post extending from the first side of the plunger body, wherein the second side of the plunger body comprises at least one actuation surface that is sized and configured to apply a compressive force onto the fluid dispenser when the plunger is depressed,
wherein the plunger is operable to actuate the fluid dispenser, and
wherein the post of the plunger protrudes through a lower intermediate member of the specimen delivery cartridge and engages an upper intermediate member of the specimen delivery cartridge when the first housing portion is closed relative to the second housing portion.

2. The specimen delivery cartridge of claim 1, wherein the plunger further comprises a second actuation post extending from the first side of the plunger body, the second actuation post being offset from the first actuation post.

3. The specimen delivery cartridge of claim 1, wherein the fluid dispenser comprises a first fluid dispenser and a second fluid dispenser, and wherein the at least one actuation surface of the plunger comprises a first actuation surface and a second actuation surface, the second actuation surface being offset from the first actuation surface relative to the second side of the plunger body,
wherein the first actuation surface is sized and configured to depress the first fluid dispenser; and
wherein the second actuation surface is sized and configured to depress the second fluid dispenser.

4. The specimen delivery cartridge of claim 3, wherein the fluid dispenser further comprises a third fluid dispenser and wherein the at least one actuation surface further comprises a third actuation surface, the third actuation surface being offset from the first actuation surface relative to the second side of the plunger body, wherein the third actuation surface is sized and configured to depress the third fluid dispenser.

5. The specimen delivery cartridge of claim 1, further comprising:
a specimen collection chamber;
a leaching chamber operable to store a reagent fluid; and
a conduit providing a fluid flow path from an outlet of the leaching chamber to an inlet of the specimen collection chamber.

6. The specimen delivery cartridge of claim 5, further comprising a sealed piston disposed in the leaching chamber and operable to displace the reagent fluid from the leaching chamber and into the specimen collection chamber through the conduit.

7. The specimen delivery cartridge of claim 5, wherein the leaching chamber comprises a blister pack.

8. The specimen delivery cartridge of claim 5, further comprising a check valve disposed between the leaching chamber and the specimen collection chamber to prevent backflow into the leaching chamber.

9. The specimen delivery cartridge of claim 5, further comprising a compressible and expandable diaphragm that is fluidly coupled to the specimen collection chamber.

10. The specimen delivery cartridge of claim 9, wherein the diaphragm is operable to agitate fluid in the specimen collection chamber when compressed.

11. The specimen delivery cartridge of claim 5, wherein the specimen collection chamber comprises a chamber gasket bonded to the first housing portion, wherein the chamber gasket forms a perimeter seal about the specimen collection chamber.

12. The specimen delivery cartridge of claim 11, wherein the chamber gasket comprises overmolded part formed using a molding process that includes using the first housing portion as a component of a mold that forms a surface of the chamber gasket.

13. A specimen delivery cartridge comprising:
a first housing portion;
a second housing portion;
a fluid dispenser;
a plunger comprising a plunger body having a first side and a second side, the second side facing away from the first side, and further comprising at least one post extending from the first side of the plunger body, wherein the second side of the plunger body comprises at least one actuation surface that is sized and configured to apply a compressive force onto the fluid dispenser when the plunger is depressed;
a specimen collection chamber;
a leaching chamber operable to store a reagent fluid; and
a conduit providing a fluid flow path from an outlet of the leaching chamber to an inlet of the specimen collection chamber,
wherein the plunger is operable to actuate the fluid dispenser, and wherein the specimen delivery cartridge further comprises a sealed piston disposed in the leaching chamber and operable to displace the reagent fluid from the leaching chamber and into the specimen collection chamber through the conduit and a spring-loaded actuator, and wherein the spring-loaded actuator is operable to actuate the piston upon closing the first housing portion relative to the second housing portion.

14. A specimen delivery cartridge comprising:

a first housing portion;

a second housing portion;

a fluid dispenser;

a plunger comprising a plunger body having a first side and a second side, the second side facing away from the first side, and further comprising at least one post extending from the first side of the plunger body, wherein the second side of the plunger body comprises at least one actuation surface that is sized and configured to apply a compressive force onto the fluid dispenser when the plunger is depressed;

a specimen collection chamber;

a leaching chamber operable to store a reagent fluid; and a conduit providing a fluid flow path from an outlet of the leaching chamber to an inlet of the specimen collection chamber, wherein the plunger is operable to actuate the fluid dispenser, and wherein the specimen collection chamber comprises a swab gasket, the swab gasket comprising a series of ridges.

15. A method of dispersing a reagent to a testing substrate, the method comprising:

closing a first housing portion of a specimen delivery cartridge toward a second housing portion of the specimen delivery cartridge, the specimen delivery cartridge further comprising a plunger having a plunger body having a first side and a second side, the second side facing away from the first side, and further comprising at least one post extending from the first side of the plunger body, wherein the second side of the plunger body comprises at least one actuation surface, wherein the specimen delivery cartridge comprises a fluid dispenser aligned with and proximate to a fluid conduit of the specimen delivery cartridge, wherein the fluid dispenser comprises a fluid, wherein closing the first housing portion relative to the second housing portion comprises:

delivering a compressive force to depress the post;

urging the actuation surface of the plunger to compress the fluid dispenser; and collapsing the fluid dispenser to urge fluid from the fluid dispenser to the fluid conduit, wherein the at least one actuation surface is sized and configured to apply a compressive force onto the fluid dispenser when the plunger is depressed, wherein the plunger is operable to actuate the fluid dispenser, and wherein the post of the plunger protrudes through a lower intermediate member of the specimen delivery cartridge and engages an upper intermediate member of the specimen delivery cartridge when the first housing portion is closed relative to the second housing portion.

16. The method of claim 15, wherein the post comprises a first post and a second post, the second post being offset from the first post.

17. The method of claim 15, wherein the plunger further comprises a second actuation surface, and wherein the specimen delivery cartridge further comprises a second fluid dispenser aligned with and proximate to a second fluid conduit, the second fluid dispenser comprising a second fluid, and wherein closing the first housing portion further comprises:

urging the second actuation surface of the plunger to compress the second fluid dispenser; and collapsing the second fluid dispenser to urge the second fluid from the second fluid dispenser to the second fluid conduit.

18. The method of claim 15, wherein the plunger further comprises a third actuation surface, and wherein the specimen delivery cartridge further comprises a third fluid dispenser aligned with and proximate to a third fluid conduit, the third fluid dispenser comprising a third fluid, and wherein closing the first housing portion further comprises:

urging the third actuation surface of the plunger to compress the third fluid dispenser by depressing the post; and collapsing the third fluid dispenser to urge the third fluid from the third fluid dispenser to the third fluid conduit.

* * * * *